US011213710B2

(12) United States Patent
Kibby

(10) Patent No.: US 11,213,710 B2
(45) Date of Patent: Jan. 4, 2022

(54) ERGONOMIC YOGA BLOCK AND METHOD OF USE

(71) Applicant: John Kibby, Annapolis, MD (US)

(72) Inventor: John Kibby, Annapolis, MD (US)

( * ) Notice: Subject to any disclaimer, the term of this patent is extended or adjusted under 35 U.S.C. 154(b) by 0 days.

(21) Appl. No.: 17/323,624

(22) Filed: May 18, 2021

(65) Prior Publication Data

US 2021/0361993 A1 Nov. 25, 2021

Related U.S. Application Data

(60) Provisional application No. 63/026,745, filed on May 19, 2020.

(51) Int. Cl.
*A63B 21/00* (2006.01)
*A63B 23/00* (2006.01)

(52) U.S. Cl.
CPC .... *A63B 21/00047* (2013.01); *A63B 21/4039* (2015.10); *A63B 23/00* (2013.01); *A63B 2023/006* (2013.01)

(58) Field of Classification Search
CPC . A63B 21/00047; A63B 21/06; A63B 21/055; A63B 21/4039; A63B 23/00; A63B 2023/006; Y10S 482/907
See application file for complete search history.

(56) References Cited

U.S. PATENT DOCUMENTS

| | | | | |
|---|---|---|---|---|
| D152,394 | S * | 1/1949 | Ceverha | D21/662 |
| 5,326,340 | A * | 7/1994 | Coffey | A63B 15/00 473/203 |
| 8,052,587 | B1 * | 11/2011 | Wu | A63B 23/0458 482/148 |
| D698,400 | S * | 1/2014 | Potts | D21/680 |
| 8,702,141 | B2 | 4/2014 | Vinciguerra | |
| D733,230 | S | 6/2015 | Mallory | |
| 9,555,275 | B1 * | 1/2017 | Izzolo, Jr. | B32B 5/18 |
| 9,814,926 | B1 | 11/2017 | Izzolo, Jr. | |
| D872,199 | S | 1/2020 | Krishock et al. | |
| 2010/0240509 | A1 * | 9/2010 | Chen | A63B 21/00047 482/148 |
| 2012/0023632 | A1 | 2/2012 | Provenzano et al. | |

* cited by examiner

*Primary Examiner* — Andrew S Lo
*Assistant Examiner* — Andrew M Kobylarz
(74) *Attorney, Agent, or Firm* — Christopher Mayle; Bold IP, PLLC

(57) ABSTRACT

A system and method for a yoga block having molding on the outer surfaces of the block to fit the hand of a user and support the hand in a neutral wrist position so as to prevent pain and discomfort in the wrist, in particular, when the user is performing yoga exercises.

17 Claims, 11 Drawing Sheets

ERGONOMIC YOGA BLOCK AND METHOD OF USE

CROSS REFERENCE TO RELATED APPLICATIONS

This application claims priority to and the benefit of U.S. Provisional Patent Application Ser. No. 63/026,745, filed on May 19, 2020, which is incorporated herein by reference in its entirety.

FIELD OF DISCLOSURE

The overall field of this invention is directed to an object for supporting a user's hands during floor-based exercising. More specifically, the invention is directed to a resilient yoga block constructed for supporting a wrist and hand of a user while performing yoga or another weight bearing exercise.

BACKGROUND

Yoga has become an increasingly popular activity for exercise. Yoga develops inner awareness and the user's attention to the abilities of the body at the present moment. Yoga develops improved breathing and increases strength of mind and body. One of the more popular accessories to use while performing yoga is a yoga block. Yoga blocks are typically made from foam, bamboo, wood, or cork. The yoga block is often used as an extension of the arms to help improve flexibility and provide stability, but can also support the back, head, and hips to help the body settle into a pose. Currently, yoga blocks are usually rectangular in shape and only have flat surfaces which are not conducive to being held comfortably by the human hand, especially in positions where the wrist of the user is bent backwards under their bodyweight.

During more weight intensive yoga poses such as these, the excess stress and load on the wrists of the user can lead to pain by causing injury to the wrist and surrounding ligaments, tendons, and muscles. This condition is commonly known as "yoga wrist." "Yoga wrist" refers to yoga related pain in the wrist, which can develop over a period of time due to repetitive stress and strain much like carpal tunnel syndrome and arthritis. Thus, there exists a need for a redesigned yoga block to help reduce excess weight bearing by repositioning the wrist from one of full backward bending to where the wrist position is more neutral. This block will help prevent pain in the wrist when a user is engaged in yoga or other exercises that involve weight bearing on the wrist.

SUMMARY

The present invention is directed to a yoga block, the yoga block comprising a body in the shape of a three dimensional rectangle, the body further modified to comprise a first cavity and second cavity in the profile of a hand for the purpose of improving wrist alignment to reduce excess wrist compression and pain, wherein the first cavity is formed through a front surface, a side surface, and a back surface, wherein the first cavity is formed by a first base wall provided in the side surface wherein the first base wall extends at a sloping angle downward a length of the side surface, wherein the first cavity is further defined by a first sidewall extending from the first base wall across the side surface to the front surface where the first sidewall terminates into a first series of finger portions, wherein a second sidewall is parallel to the first sidewall, wherein the second sidewall extends from the first series finger portions across the front surface on an opposite side of the first series of finger portions from the first sidewall, wherein the second sidewall then extends upward at an angle along the side surface such that the second sidewall and the first sidewall and the first base wall create a first palm portion, wherein the second sidewall terminates into a first thumb portion on the back surface, wherein the second cavity is formed through the front surface, the top surface, and the back surface, wherein the second cavity is formed by a second base wall provide in the top surface wherein the second base wall extends at a sloping angle downward a length of the top surface, wherein the second cavity is further defined by a third sidewall extending from the second base wall across the top surface to the back surface where the third sidewall terminates into a second series of finger portions, wherein the third sidewall is parallel to a fourth sidewall, wherein the fourth sidewall extends from the second series finger portions across the back surface on a opposite side of the second series of finger portions from the third sidewall, wherein the fourth sidewall then extends upward at an angle along the top surface such that the third sidewall and the fourth sidewall and the second base wall create a second palm portion, wherein the fourth sidewall terminates into a second thumb portion on the front surface.

The present invention is also directed to a yoga block comprising a body, the body comprising a first cavity and a second cavity for the purpose of improving wrist alignment to reduce excess wrist compression and pain, wherein the first cavity is defined by a first base wall, the first cavity further defined by a first sidewall extending from the first base wall where it terminates into a first series of finger portions, wherein a second sidewall extends from the first finger portions wherein the second sidewall, the first sidewall, and the base wall create a first palm portion, wherein the second sidewall terminates into a first thumb portion, wherein the second cavity is formed by a second base wall, wherein the second cavity is further defined by a third sidewall extending from the second base line where the third sidewall terminates into a second series of finger portions, wherein the third sidewall is parallel to a fourth sidewall that extends from the second series finger portions, wherein the third sidewall and the fourth sidewall and the second base wall create a second palm portion, wherein the fourth sidewall terminates into a second thumb portion The present invention is also directed to a method of using a yoga block, the method comprising placing a first hand on the body of the yoga block, the body comprising two cavities in the profile of a hand shape for the purpose of improving wrist alignment to reduce excess wrist compression and pain and placing a second hand on the body of a second yoga block, the body comprising two cavities in the profile of a second hand shape.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
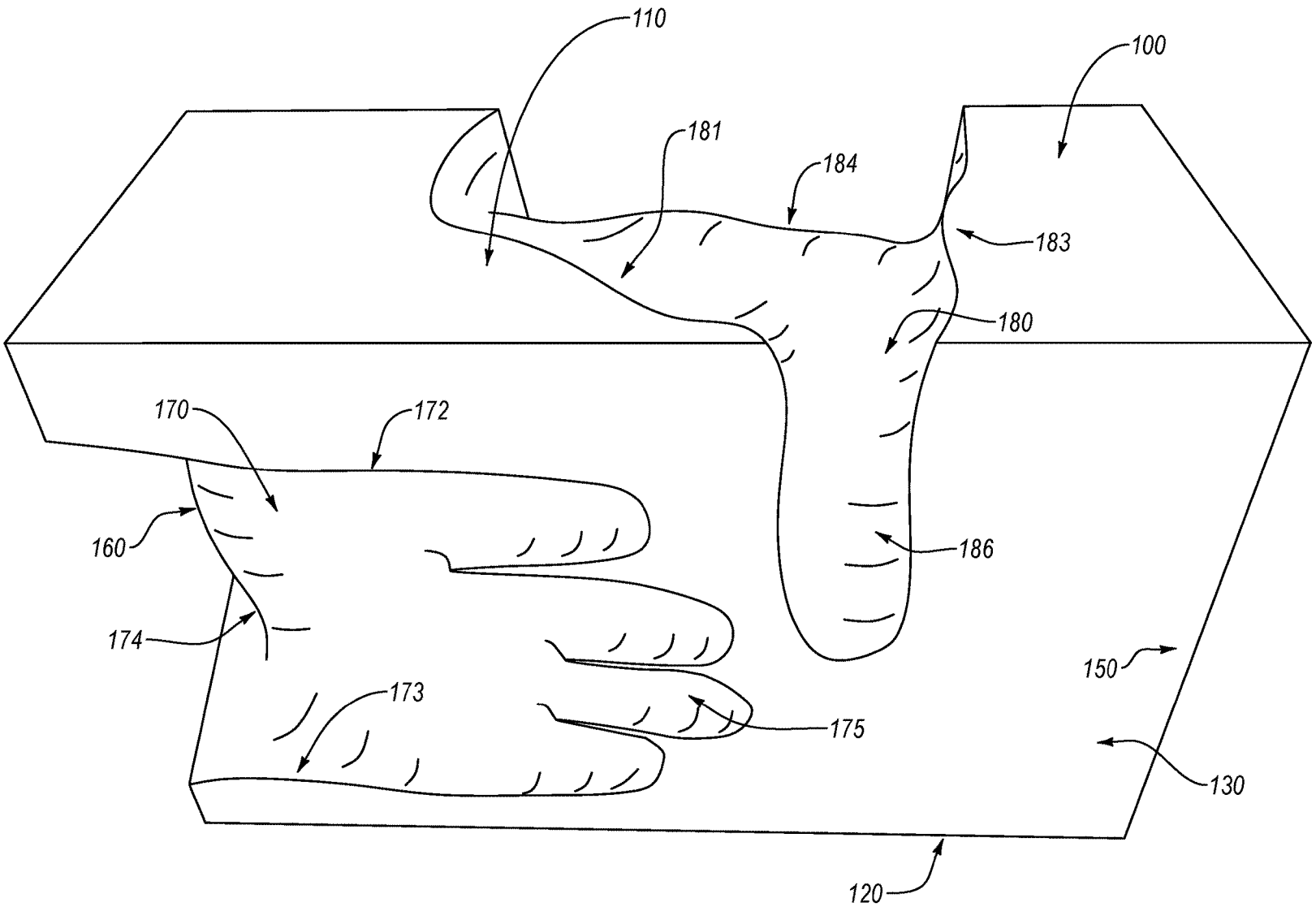
FIG. 1 is an illustration showing a perspective top view of an embodiment of an ergonomic yoga block in accordance with an illustrative embodiment.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item or may indicate more items. Thus, the term "set" may be equivalent to "one or more" as used herein.

The present disclosure recognizes the unsolved need for a yoga block having molding on the outer surfaces of the block to fit the hand of user and support the hand in a neutral wrist position so as to prevent wrist compression, pain, and discomfort in the wrist, in particular, when the user is performing yoga exercises. Further, the one or more non-limiting embodiments provided herein for a yoga block may help to improve proper form while performing more difficult poses. The size, shape, and contoured surfaces of the presently described embodiments are particularly well suited for use as a yoga block due to its versatility in application to a variety of yoga postures and positions.

Figure 2:
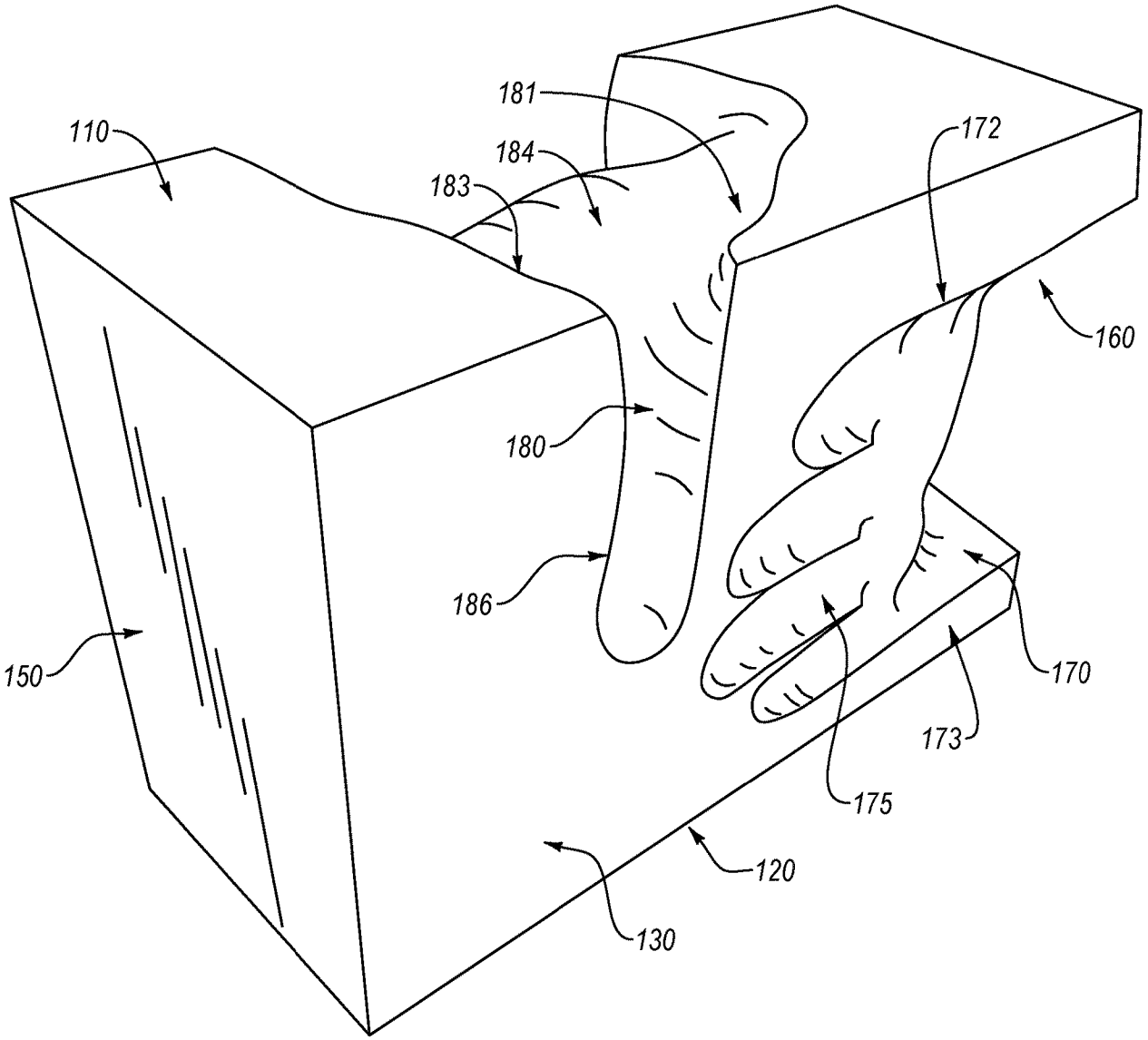
FIG. 2 is an illustration showing a perspective top view of a second embodiment of an ergonomic yoga block in accordance with an illustrative embodiment.

With reference now to FIG. 2-11, one exemplary embodiment of yoga block 100, according to the present invention is generally designated. In one or more non-limiting embodiments, yoga block 100 may include a three-dimensional rectangular body (as shown in FIG. 2) having a top surface 110, bottom surface 120, and a series of sidewalls extending between and interconnecting top surface 110 and bottom surface 120. Yoga block 100 may further include front surface 130, left surface 150, and right surface 160, which are all shown in FIG. 2. Yoga block 100 may further include back surface 140, which is first shown in FIG. 3.

In one or more non-limiting embodiments, yoga block 100 may be designed for an individual's right hand or left hand. In FIGS. 2-11, yoga block 100 includes the cavities (i.e., cavities 170 and 180 as shown in FIG. 2) that correspond to a user's right hand, however, in other embodiments, cavities 170 and 180 may be formed in yoga block 100 to suit a user's left hand as illustrated in FIG. 1. In one or more non-limiting embodiments, the user may have two yoga blocks 100 whereby one may be useful for the user's right hand and the other one useful for the user's left hand, which may be used together or separately whereby the second yoga block may have similar components but with a mirror image to yoga block 100. Yoga block 100 may be made of any suitable material, including but not limited to, wood, cork, plastic, rubber, or foam. In some embodiments cavities may have bumps or protrusions to prevent hands from slipping.

In a non-limiting embodiment, the length of top surface 110 and bottom surface 120 may be 9 inches long and the width may be 4 inches wide. In one or more non-limiting embodiments, the length of front surface 130 and back surface 140 is 9 inches and the height is 6 inches. Additionally, in one or more non-limiting embodiments, the width of right surface 160 and left surface 150 is 4 inches and the height is 6 inches. It is noted that these listed dimensions are exemplary only and non-limiting. Yoga block 100 may be any shape and size depending on the specific need and circumstances of the user.

Figure 3:
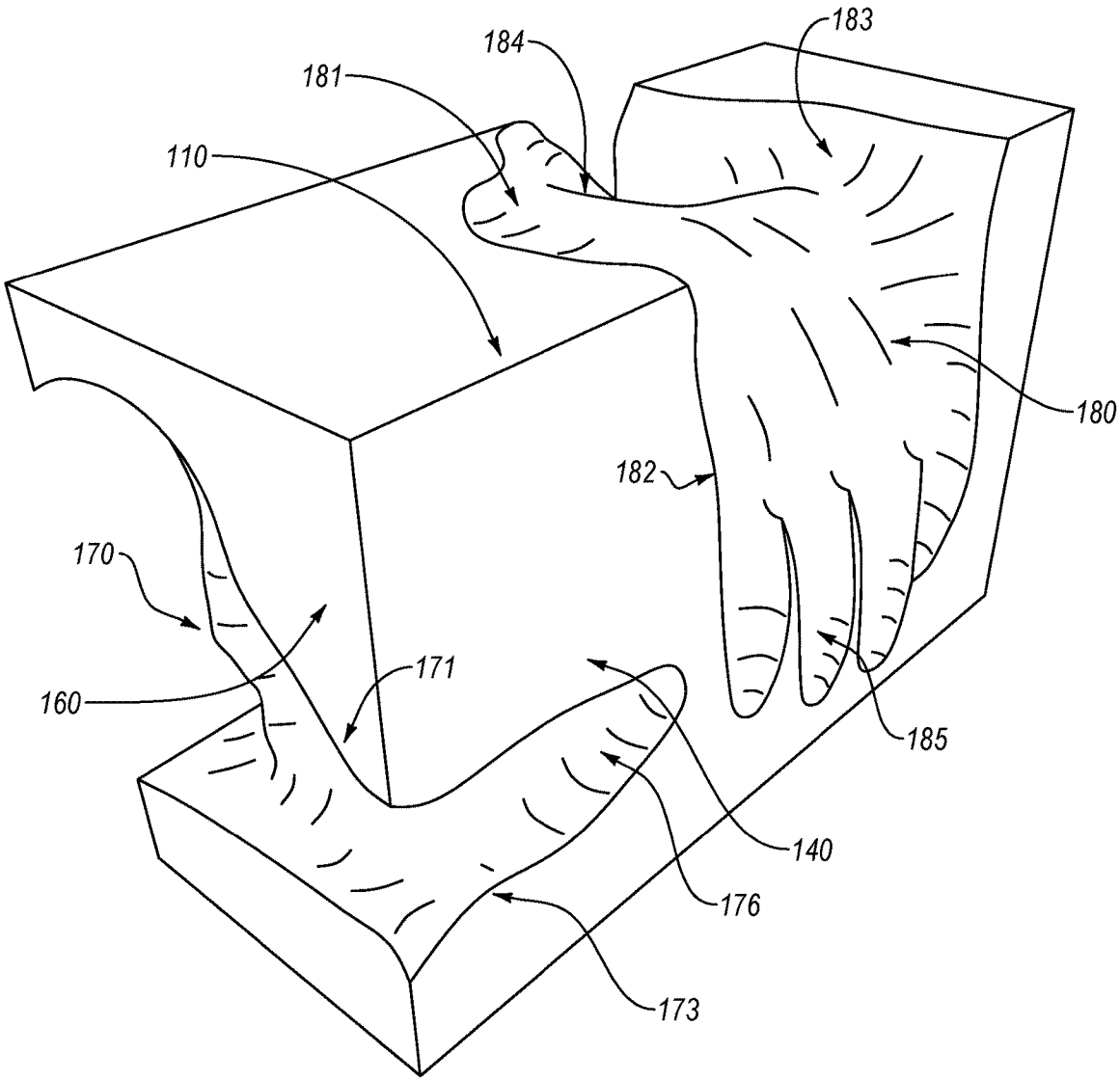
FIG. 3 is an illustration showing another perspective top view of the ergonomic yoga block of FIG. 2 in accordance with an illustrative embodiment.
Figure 4:
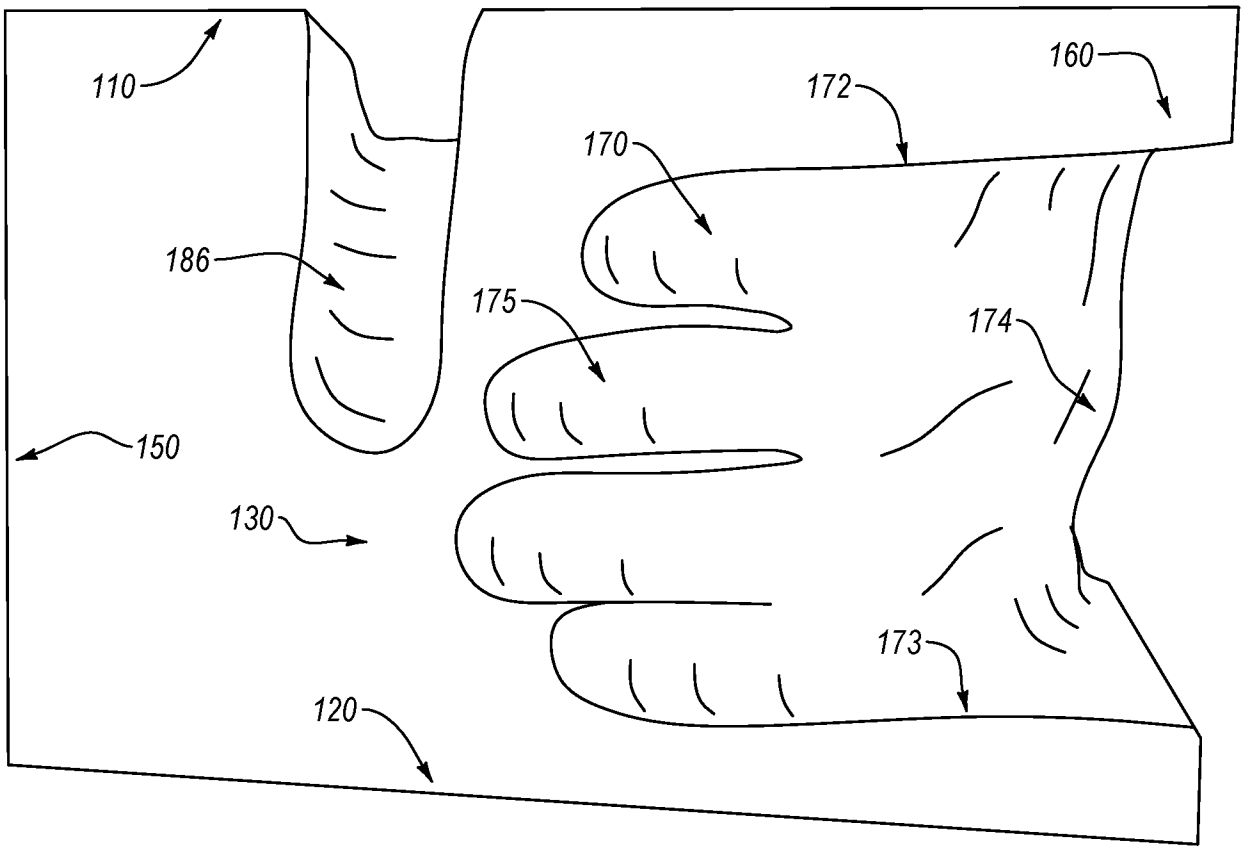
FIG. 4 is an illustration showing a front view of the ergonomic yoga block of FIG. 2 in accordance with an illustrative embodiment.
Figure 5:
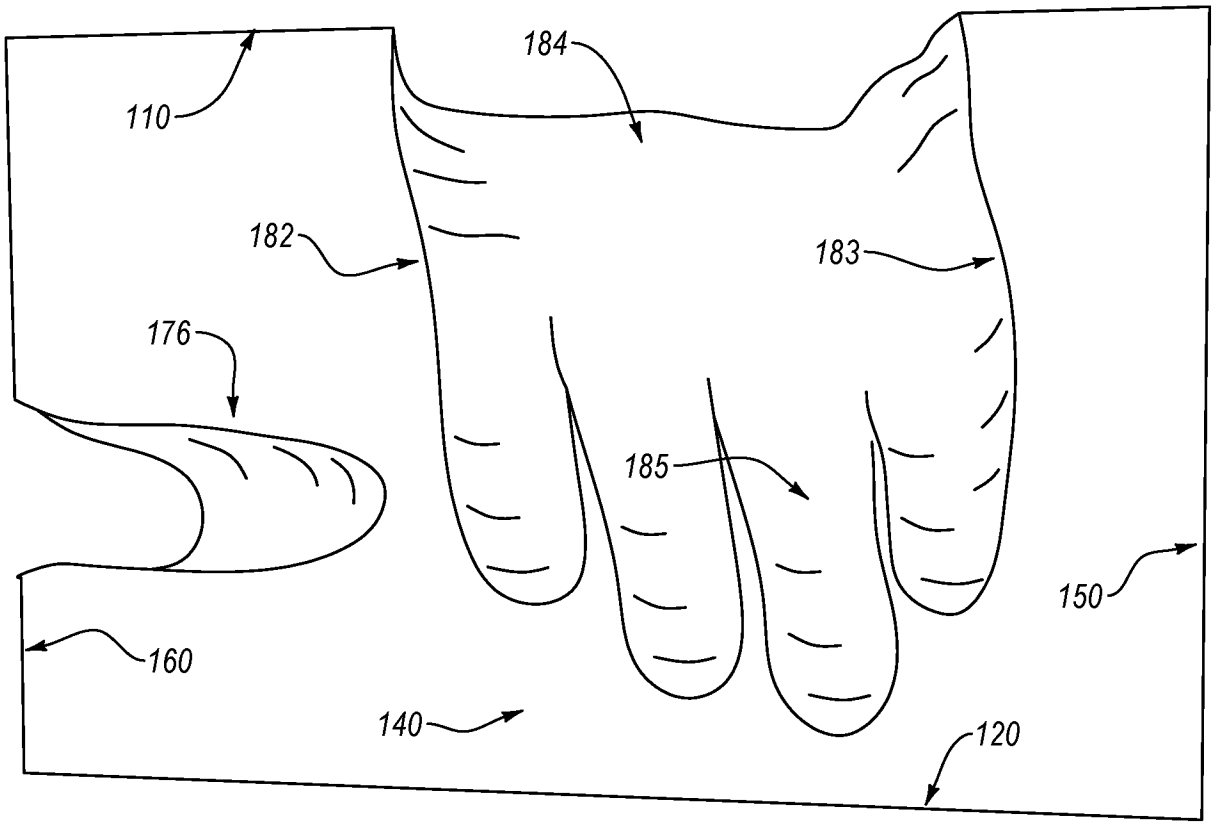
FIG. 5 is an illustration showing a back view of the ergonomic yoga block of FIG. 1 in accordance with an illustrative embodiment.
Figure 6:
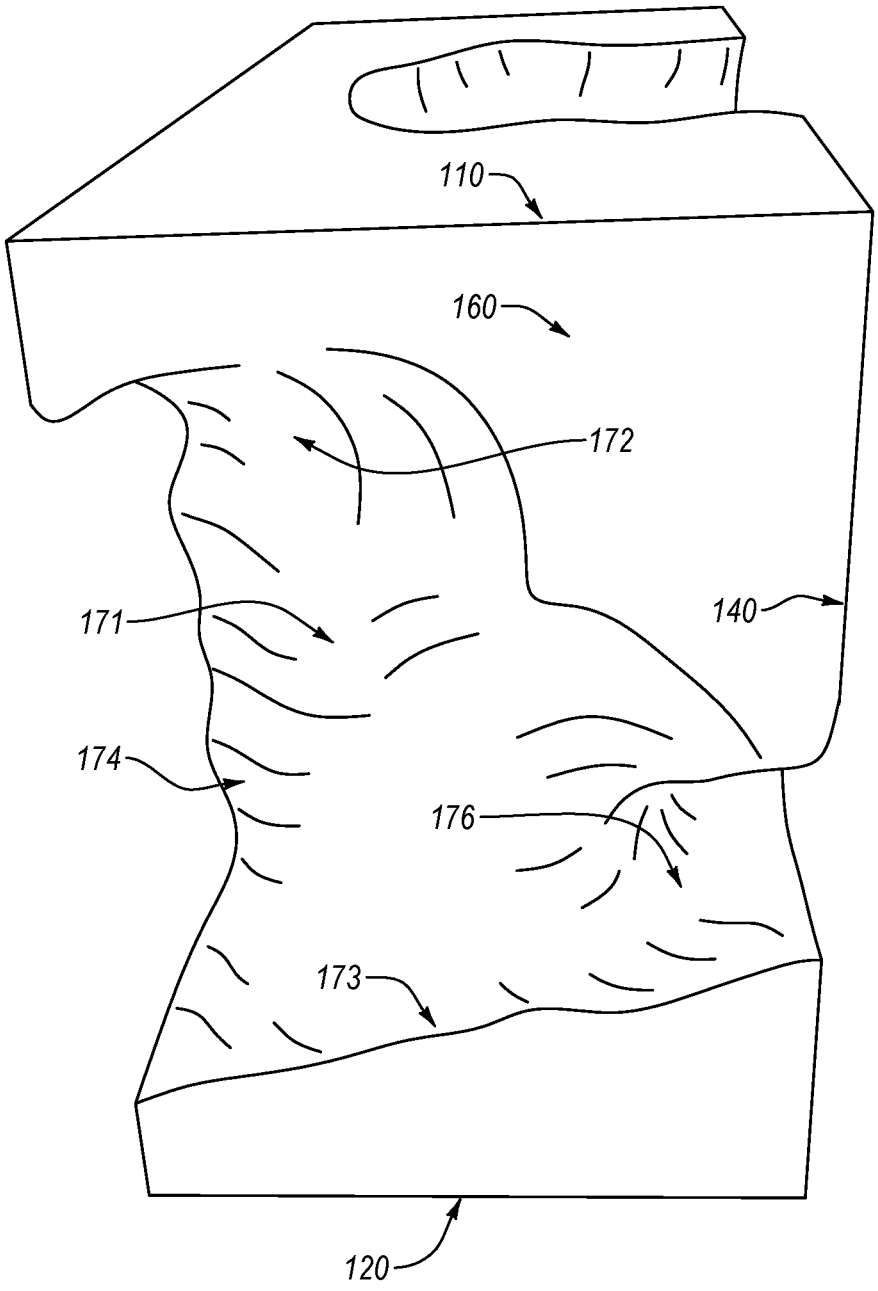
FIG. 6 is an illustration showing a right side view of the ergonomic yoga block of FIG. 2 in accordance with an illustrative embodiment.
Figure 7:
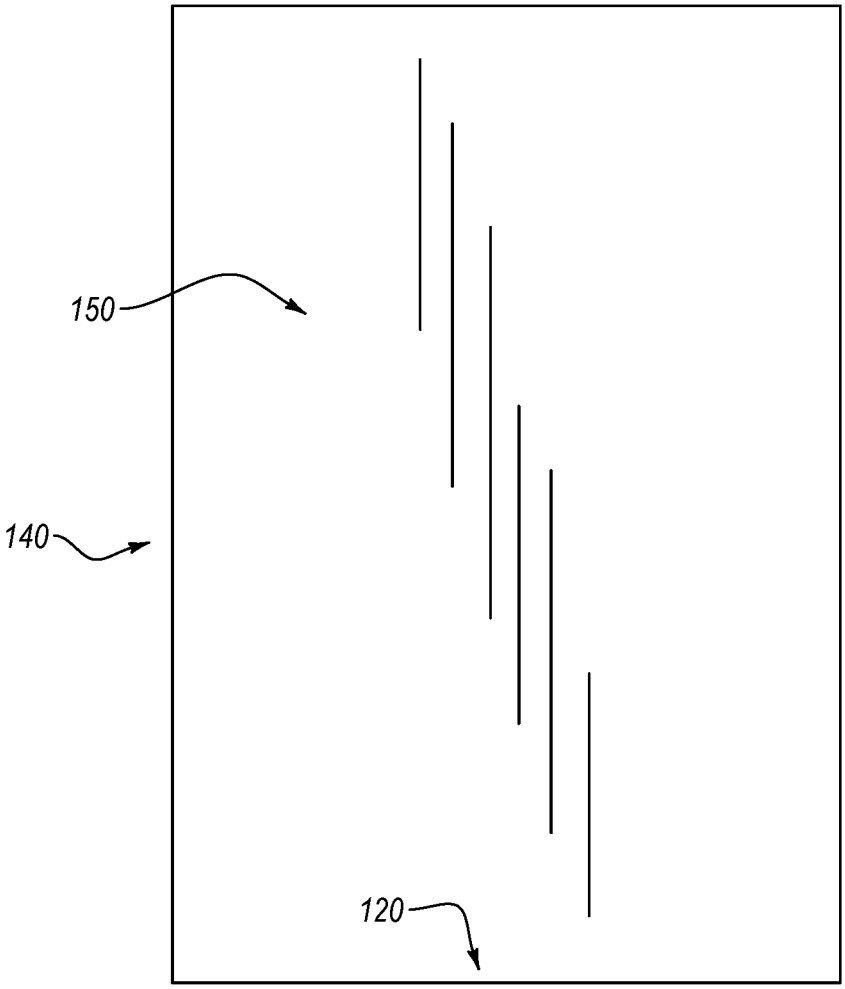
FIG. 7 is an illustration showing a left side view of the ergonomic yoga block of FIG. 2 in accordance with an illustrative embodiment.
Figure 8:
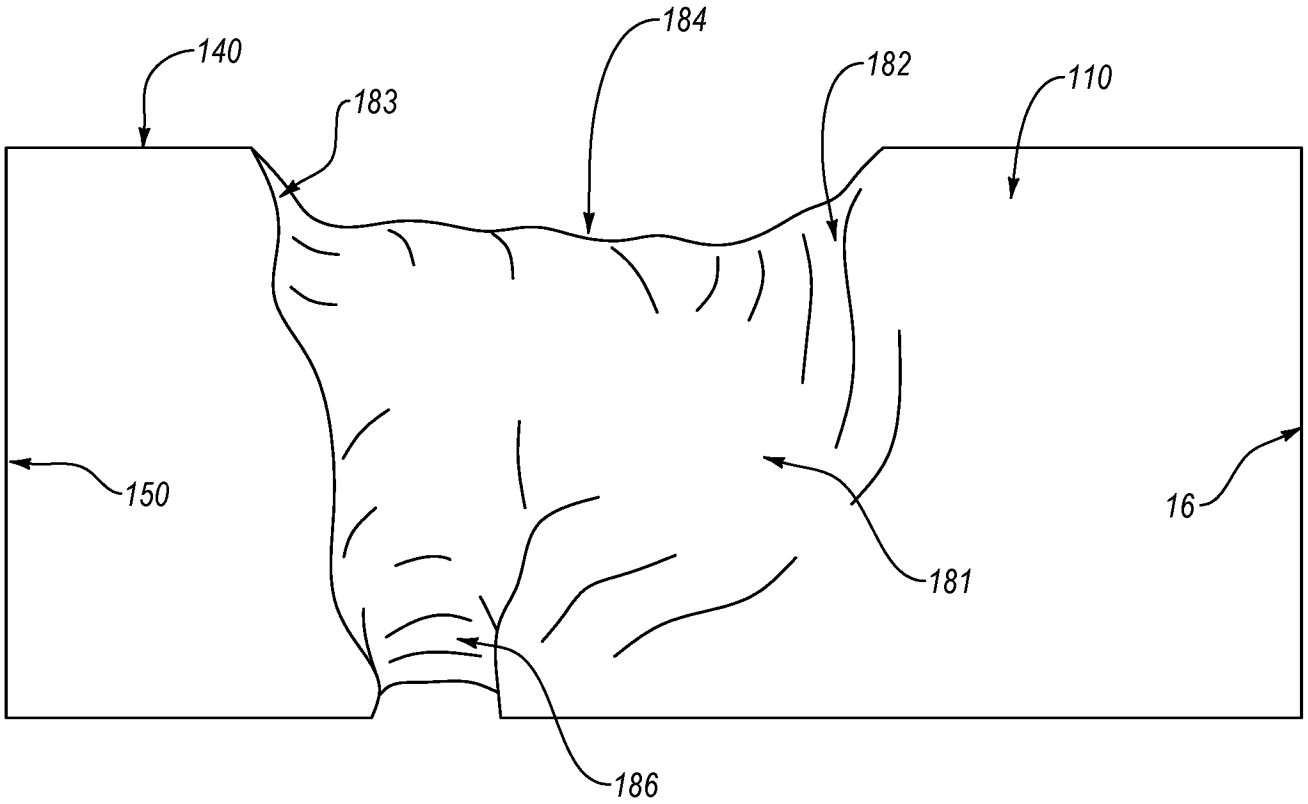
FIG. 8 is an illustration showing a top view of the ergonomic yoga block of FIG. 2 in accordance with an illustrative embodiment.
Figure 9:
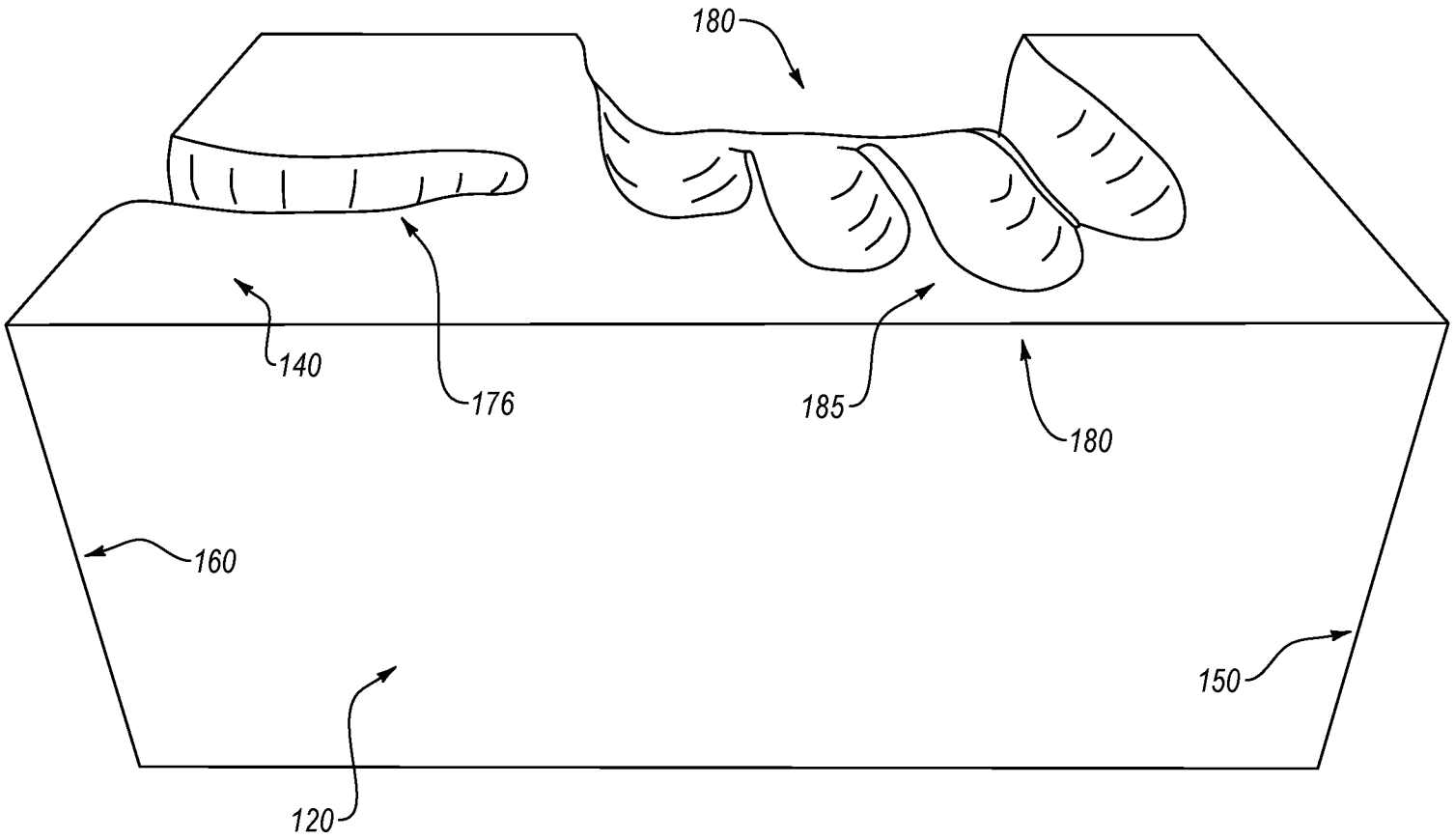
FIG. 9 is an illustration showing a bottom perspective view of the ergonomic yoga block of FIG. 1 in accordance with an illustrative embodiment.
Figure 10:
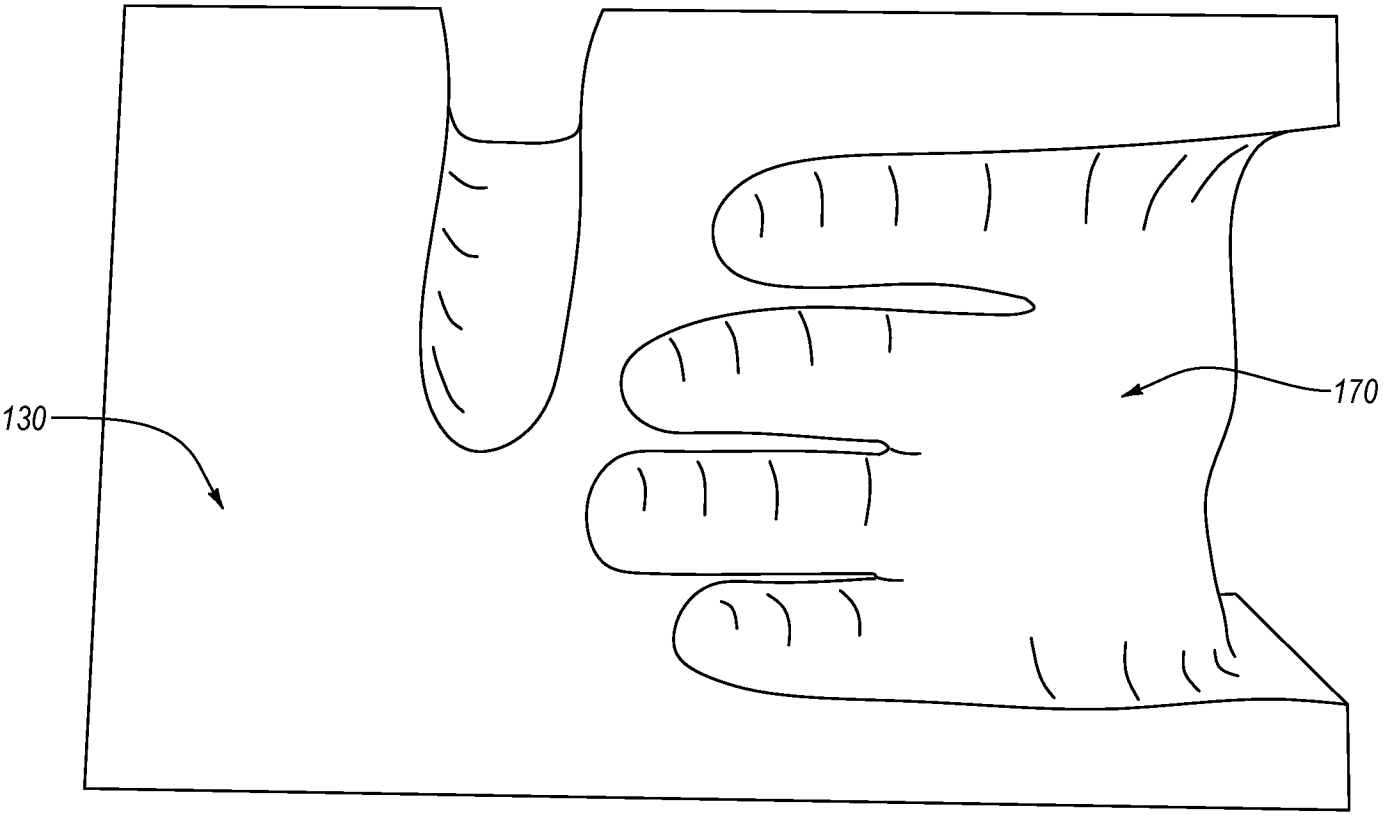
FIG. 10 is an illustration showing a top angled view of the right side view of the ergonomic yoga block of FIG. 2 in accordance with an illustrative embodiment.

In one or more non-limiting embodiments, yoga block 100 may include a first cavity 170 and second cavity 180 (e.g., as shown in FIG. 2) debossed, or otherwise formed or created in the body of yoga block 100. First cavity 170 and second cavity 180 may have a profile of a palm, fingers, and a thumb of a user that enables first cavity 170 and second cavity 180 to receive the palm, fingers, and thumb of a hand of a user therein, in particular, when used to perform yoga exercises. First cavity 170 and second cavity 180 may have a plurality of ridges and curves to accommodate for different activities. The primary purpose of this redesigned yoga block is to support the wrist in the neutral or straight position to reduce the stress and strain on the wrist First cavity 170 is formed through front surface 130, right surface 160, and back surface 140, More particularly, first cavity 170 is formed by a base wall 171 (e.g., as shown in FIG. 3) provided in right surface 160 whereby base wall 171 extends at a sloping angle downward a length of right surface 160. First cavity 170 is further defined by a sidewall 172, as shown in FIG. 2, extending from base wall 171 across right surface 160 to front surface 130 where it terminates into a series of finger portions 175 (e.g., as shown in FIG. 4) having an elongated arched form with a curvature of the profile of the fingers of a human hand so as to enable fingers of the hand of the user to be received into first cavity 170 when the palm is positioned on right surface 160 and wrapped around to front surface 130 and thumb is positioned in thumb portion 176 on back surface 140.

In one or more non-limiting embodiment, a sidewall 173 parallel to sidewall 172 extends from finger portions 175 across front surface 130 on the opposite side of finger portions 175 from sidewall 172. Sidewall 173 then extends upward at an angle along right surface 160 such that the sidewall 172 and 173 and base wall 171 create a palm portion 174 (e.g., as shown in FIG. 2) that aids in the retention of the palm of the user. Sidewall 173 terminates into a thumb portion 176 on back surface 140, which is more clearly shown in FIG. 3. Thumb portion 176 may have substantially arched form, connecting with base wall 171 on the opposite end to form a curvature of the profile of a thumb of a user.

Second cavity 180 is formed through front surface 130, top surface 110, and back surface 140 as shown in FIG. 2 and FIG. 3. More particularly, second cavity 180 is formed by a base wall 181 provided in top surface 110 whereby base wall 181 extends at a sloping angle downward a length of top surface 110. Second cavity 180 is further defined by a sidewall 182 extending from base wall 181 across top surface 110 to back surface 140 where it terminates into a series of finger portions 185 having elongated arched form with a curvature of the profile of the fingers of a human hand so as to enable fingers of the hand of the user to be received into second cavity 180 when the palm is positioned on top surface 110 and wrapped around to back surface 140 and thumb is positioned in thumb portion 186 on front surface 130.

A sidewall 183 parallel or substantially parallel to sidewall 182 extends from finger portions 185 across back surface 140 on the opposite side of finger portions 185 from sidewall 182. Sidewall 183 then extends upward at an angle along top surface 110 such that the sidewall 182 and 183 and base wall 181 create a palm portion 184 that aids in the retention of the palm of the user. Sidewall 183 terminates into a thumb portion 186 (e.g., as shown in FIG. 2) on front surface 130. Thumb portion 186 may have substantially arched form, connecting with thumb portion 186 on the opposite end of base wall 181 to form a curvature of the profile of a thumb of a user.

Yoga block 100 is designed to be orientated to operate in two different configurations when placed on a floor or another surface. By ergonomically structuring yoga block 100 to prevent excessive bending and/or extension of the wrist, the user is able to more comfortably attain and maintain certain yoga postures in these configurations with less wrist pain and discomfort than conventional yoga blocks.

A first configuration, as shown in FIG. 2, may be where yoga block 100 is positioned at a second highest elevation point whereby bottom surface 120 is in contact with the ground or another surface. In this configuration, the user would grip yoga block by placing their palm in palm portion 184 on top surface 110 and positioning their fingers in finger portions 185 and their thumb in thumb portion 186.

Figure 11:
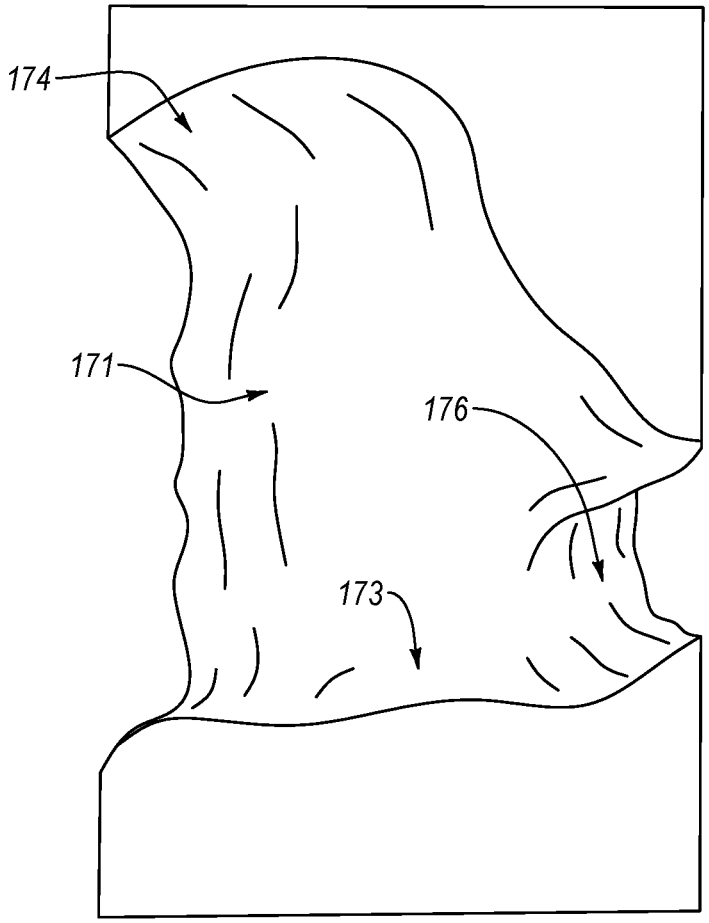
FIG. 11 is an illustration showing a top angled view of the front side view of the ergonomic yoga block of FIG. 2 in accordance with an illustrative embodiment.

A second configuration, as shown in FIG. 11, may be where yoga block 100 is positioned at a highest elevation point whereby left surface 150 is in contact with the ground or another surface. In this configuration, the user would grip yoga block 100 by placing their palm in palm portion 174 on right surface 160 and positioning their fingers in finger portions 175 and their thumb in thumb portion 176.

In addition to these configurations, yoga block 100 may be used as a conventional block, defined as a block with only flat surfaces. In one conventional configuration the block may be placed at the highest elevation point whereby right surface 160 is on the ground or another surface. In this configuration, the user would grip yoga block 100 by placing their palm on left surface 150 and positioning their fingers and thumb over the edges of left surface 150. In a second conventional configuration the block may be placed at the second highest elevation point whereby top surface 110 is on the ground or another surface. In this configuration, the user would grip yoga block 100 by placing their palm on bottom surface 120 and positioning their fingers and thumb over the edges of bottom surface 120.

Accordingly, the one or more non-limiting embodiments described above for yoga block 100 provide a much needed and improved yoga block over existing options for anyone practicing yoga. As described above, the design of the yoga block minimizes wrist pain by improving the ability of the user to attain and maintain the proper form and wrist alignment for various yoga poses.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A yoga block, the yoga block comprising:

a body in a shape of a three-dimensional rectangle, the body further modified to comprise a first cavity and second cavity in a profile of a hand for improving wrist alignment to reduce excess wrist compression and pain, wherein the first cavity and the second cavity are asymmetrical to one another, wherein the first cavity is formed through a front surface, a side surface, and a back surface.

2. The yoga block of claim 1, wherein the first cavity is formed by a first base wall provided in the side surface wherein the first base wall extends at a sloping angle downward a length of the side surface.

3. The yoga block of claim 2, wherein the first cavity is further defined by a first sidewall extending from the first base wall across the side surface to the front surface where the first sidewall terminates into a first series of finger portions.

4. The yoga block of claim 3, wherein a second sidewall extends from the first series of finger portions across the front surface on an opposite side of the first series of finger portions from the first sidewall.

5. The yoga block of claim 4, wherein the second sidewall then extends upward at an angle along the side surface such that the second sidewall and the first sidewall and the first base wall create a first palm portion.

6. The yoga block of claim 5, wherein the second sidewall terminates into a first thumb portion on the back surface.

7. The yoga block of claim 6, wherein the second cavity is formed through the front surface, a top surface, and the back surface.

8. The yoga block of claim 7, wherein the second cavity is formed by a second base wall provide in the top surface wherein the second base wall extends at a sloping angle downward a length of the top surface.

9. The yoga block of claim 8, wherein the second cavity is further defined by a third sidewall extending from the second base wall across the top surface to the back surface where the third sidewall terminates into a second series of finger portions.

10. The yoga block of claim 9, wherein a fourth sidewall extends from the second series of finger portions across the back surface on a opposite side of the second series of finger portions from the third sidewall.

11. A yoga block, the yoga block comprising:

a body, the body comprising a first cavity and a second cavity for improving wrist alignment to reduce excess wrist compression and pain, wherein the first cavity is formed in a first surface, a second surface, and a third surface, wherein the second cavity is formed in the first surface, the second surface, and a fourth surface.

12. The yoga block of claim 11, wherein the first surface is a front surface and the second surface is a rear surface.

13. The yoga block of claim 12, wherein the second cavity is formed by a second base wall, wherein the third surface is a side surface and the fourth surface is a top surface.

14. The yoga block of claim 13, wherein the first cavity and the second cavity are in a shape of a hand.

15. A yoga block, the yoga block comprising:

a body, the body having a first cavity and a second cavity for improving wrist alignment to reduce excess wrist compression and pain, wherein the first cavity and the second cavity are each in a profile of a single hand, wherein the first cavity is formed in a first surface, a second surface, and a third surface, wherein the second cavity is formed in the first surface, the second surface, and a fourth surface.

16. The yoga block of claim 15, wherein the first cavity and the second cavity are asymmetrical.

17. The yoga block of claim 15, wherein the first cavity and the second cavity are in a form of a grasping hand.

* * * * *